United States Patent [19]

Bartolles

[11] Patent Number: 5,058,304

[45] Date of Patent: Oct. 22, 1991

[54] DUAL-CATCH TRIGGER MECHANISM

[75] Inventor: Rolf Bartolles, Korschenbroich, Fed. Rep. of Germany

[73] Assignee: Rheinmetall GmbH, Düsseldorf, Fed. Rep. of Germany

[21] Appl. No.: 554,723

[22] Filed: Jul. 19, 1990

[30] Foreign Application Priority Data

Jul. 21, 1989 [DE] Fed. Rep. of Germany ..... 3924042

[51] Int. Cl.[5] ..... F41A 17/64

[52] U.S. Cl. ..... 42/69.01; 89/27.13; 42/70.08

[58] Field of Search ..... 89/27.12, 27.13, 27.14, 89/27.3; 42/69.01, 69.02, 70.08

[56] References Cited

U.S. PATENT DOCUMENTS 3,951,041 4/1976 Bartolles ..... 89/24

FOREIGN PATENT DOCUMENTS 1553923 5/1971 Fed. Rep. of Germany .
2362131 9/1978 Fed. Rep. of Germany .
3707063 9/1988 Fed. Rep. of Germany .
3708930 10/1988 Fed. Rep. of Germany .
2202316 9/1988 United Kingdom .

*Primary Examiner*—Michael J. Carone
*Attorney, Agent, or Firm*—Spencer & Frank

[57] ABSTRACT

A trigger mechanism includes a firing pin having a cocked position and a firing position into which the firing pin is adapted to be accelerated; a catch having a locking position for engaging the firing pin in the cocked position to hold the firing pin; a spring operatively connected to the catch for urging the catch into the locking position; a first actuating bar connected to the catch; a standby catch having a locking position in which the standby catch is situated in the path of motion of and out of contact with the firing pin for preventing the firing pin from moving from the cocked position into the firing position; a second actuating bar connected to the standby catch; and a force-transmitting arrangement for simultaneously applying a triggering force to the first and second actuating bars for simultaneously displacing them to simultaneously move the catch and the standby catch from respective locking positions to respective withdrawn positions.

18 Claims, 1 Drawing Sheet

DUAL-CATCH TRIGGER MECHANISM

BACKGROUND OF THE INVENTION

This invention relates to a trigger mechanism, particularly for an automatic firing mechanism to fire propellant-igniting cartridges. The trigger mechanism includes a catch urged by a spring into a position in which it engages a detent surface of a cocked firing pin, blocking a forward (firing) movement thereof. For withdrawing the catch from the blocking position to thus cause the firing pin to be launched, the catch is positively connected to a rocker lever which, in turn, is coupled to a rocker lever bar. Thus, by longitudinally displacing the rocker lever bar in the direction of release, the motion is transmitted to the catch by the rocker lever, whereby the catch is withdrawn, and the pin accelerates into its firing position.

A trigger mechanism in which a nose of a cocked firing pin is held by a catch is disclosed in Federal Republic of Germany Patent No. 2,362,131, a counterpart of U.S. Pat. No. 3,951,041. If the nose of the firing pin or the catch breaks, the safety of the weapon would be compromised to the greatest degree since accidental firing could occur. Furthermore, the situation can arise that, owing to excessive rubbing or friction of the catch, there is only partial securing of the firing pin by the catch resulting from a so-called "side catch". In that condition, an unstable firing state can arise, in which the possibility of an unintentional firing of the weapon owing to shocks cannot be excluded.

SUMMARY OF THE INVENTION

It is an object of the invention to provide an improved firing pin safety for a trigger mechanism of the above-outlined type which does not compromise the safety of the weapon even when there is a break of the firing pin nose or of the catch, or even when the firing pin has been incompletely secured by the catch.

This object and others to become apparent as the specification progresses, are accomplished by the invention, according to which, briefly stated, the trigger mechanism includes a firing pin having a cocked position and a firing position into which the firing pin is adapted to be accelerated; a catch having a locking position for engaging the firing pin in the cocked position to hold the firing pin; a spring operatively connected to the catch for urging the catch into the locking position; a first actuating bar connected to the catch; a standby catch having a locking position in which the standby catch is situated in the path of motion of and out of contact with the firing pin for preventing the firing pin from moving from the cocked position into the firing position; a second actuating bar connected to the standby catch; and a force-transmitting arrangement for simultaneously applying a triggering force to the first and second actuating bars for simultaneously displacing them to simultaneously move the catch and the standby catch from respective locking positions to respective withdrawn positions.

According to the invention the weapon is made significantly safer and thus an uncontrolled initiation of the firing process is prevented by the provision of a standby catch which, in a locking position, blocks the firing pin independently from the blocking function of the catch. The locking movement of the standby catch independently of the catch can be carried out directly through a separate, second rocker lever bar, as the standby catch is designed as a space-saving angled lever and the locking movement is produced by a spring acting on the second rocker lever bar along its axis.

In a particularly advantageous manner, a complete restraint of the firing pin is guaranteed by the standby catch, even when the firing pin is only held by the front side of the catch, as the locking movement of the standby catch is effected in a frictionless manner relative to the firing pin and the standby catch secures the firing pin in its cocked position in a contactless manner. If the catch slides off the nose of the firing pin, or the catch or the nose of the firing pin breaks off, the standby catch ensures a secure capture of the cocked firing pin.

By virtue of the fact that the standby catch overlaps the opposed detent surface of the firing pin less than the catch overlaps its respective detent surface on the firing pin, and that the standby catch is released concurrently with the catch by a common pressing rod, a more disturbance-free and safer normal firing operation is achieved, because the catch releases the firing pin only at the moment such concurrent release is performed by two angled levers which engage each rocker lever bar and which are disposed symmetrically relative to and are actuatable by the pressing rod.

The firing pin safety according to the invention can be readily retrofitted in existing trigger mechanisms for automatic propellant igniters. There is ample space in the housing of conventional automatic propellant igniters for accommodating the second rocker lever bar and the second angled lever as well as the standby catch.

DETAILED DESCRIPTION OF THE PREFERRED EMBODIMENT

Figure 1:
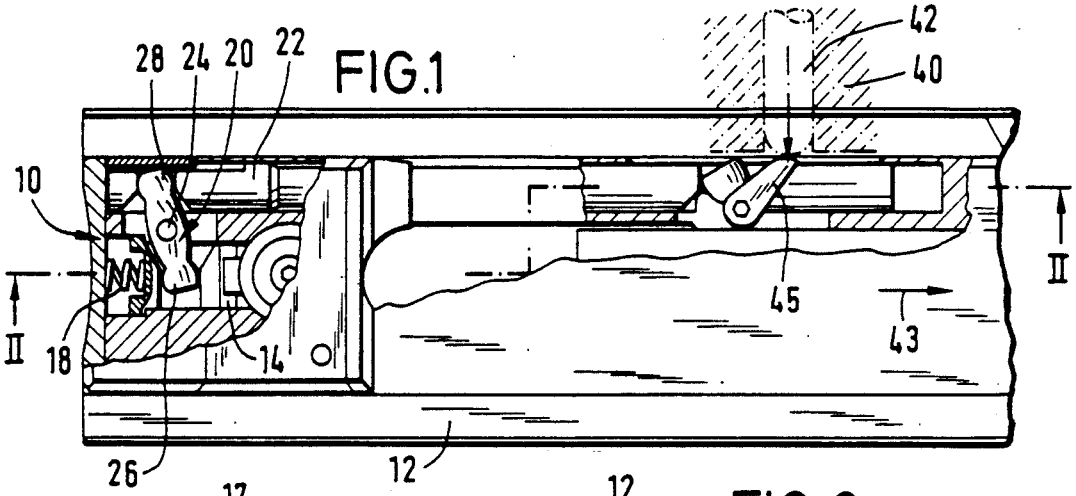
FIG. 1 is a sectional side elevational view of a construction incorporating a preferred embodiment of the invention.

Turning to FIGS. 1-5, a trigger mechanism 10 shown therein and constructed according to the invention is disposed within a conventional automatic propellant igniter 12. Such conventional automatic propellant igniters are shown, for example, in U.S. Pat. No. 3,951,041, or United Kingdom Patent 2,202,316. Automatic propellant igniters 12 of this type serve to ignite the propellant in the gun barrels of large caliber weapons such as depicted in the patent documents discussed above.

Trigger mechanism 10 of the automatic propellant igniter 12 has a conventional catch 14 for securing a firing pin 16 under action of a spring 18. For releasing the firing pin 16, the catch 14 is positively attached to a first rocker lever bar (first actuating bar) 22 through a rocker lever 20. The rocker lever 20 has lever arms 26 and 28 on opposite sides of the axis of rotation 24 of the rocker lever 20. The lever arm 26 extends into the catch 14 and the lever arm 28 extends into the first rocker lever bar 22.

The release of the catch 14 is brought about by the first rocker lever bar 22 which is moved in a releasing direction 43 when pressing rod 42 presses downwardly on an angled lever 45. The schematically shown pressing rod 42 is received in a conventional breech plate 40 and its movement is part of a typical chain of functions for the releasing process, as is known from German Offenlegungsschrift 3,707,063 (published unexamined application). After the releasing of catch 14, the firing pin 16 is moved in a conventional manner such as disclosed in U.S. Pat. No. 3,951,041. Thus, the firing pin 16 is moved by cocking cam 17 against the force of a firing pin spring 15 until a securing surface 13 of the catch 14 can engage behind a first detent surface 54 of a nose of firing pin 16.

According to the invention a second rocker lever bar (second actuating bar) 30 is movably disposed in an elongated bore 29 within the automatic propellant igniter 12 and parallel to the first rocker lever bar 22. The second rocker lever bar 30 has a groove 31 on the side facing the firing pin 16 for making a positive locking engagement with a cylindrical lug 33 of a standby catch 34. The standby catch 34 is pivotally attached in the middle to a bearing pin 32 secured to the housing. The standby catch 34 is pivoted about the pin 32 by the axial displacement of the second rocker lever bar 30. Preferably, the standby catch 34 is configured as a flat angled lever, of which a free lever arm 48 forms a right angle with a lever arm 50 operatively connected with the second rocker lever bar 30. By virtue of the fact that the second rocker lever bar 30 is contacted by a spring 46 disposed in the bore 29 at a bar end remote from the standby catch 34, the second rocker lever bar 30 is biased along its axis in the direction of arrow 35 so that in its position of rest, the second rocker lever bar 30 abuts a stop 27 on the housing in the vicinity of the standby catch 34. In this position of the second rocker lever bar 30 the lever arm 48 of the standby catch 34 assumes a locking position 38 above a second detent surface 52 of an additional nose of the firing pin 16. The locking position 38 is established by the standby catch 34 independently from the establishment of the locking position 36 of the catch 14. A securing surface 56 on the standby catch 34 can engage the detent surface 52 of the firing pin 16. In the locking position 38 the securing surface 56 of the lever arm 48 of the standby catch 34 is spaced from the second detent surface 52 of the firing pin 16 by an axial distance a owing to the blocking of the first detent surface 54 by the catch 14 which restrains the firing pin 16. Accordingly, the standby catch 34 can assume its locking position 38 with the firing pin 16 in a contactless and friction free manner and with no resistance or delay.

Figure 2:
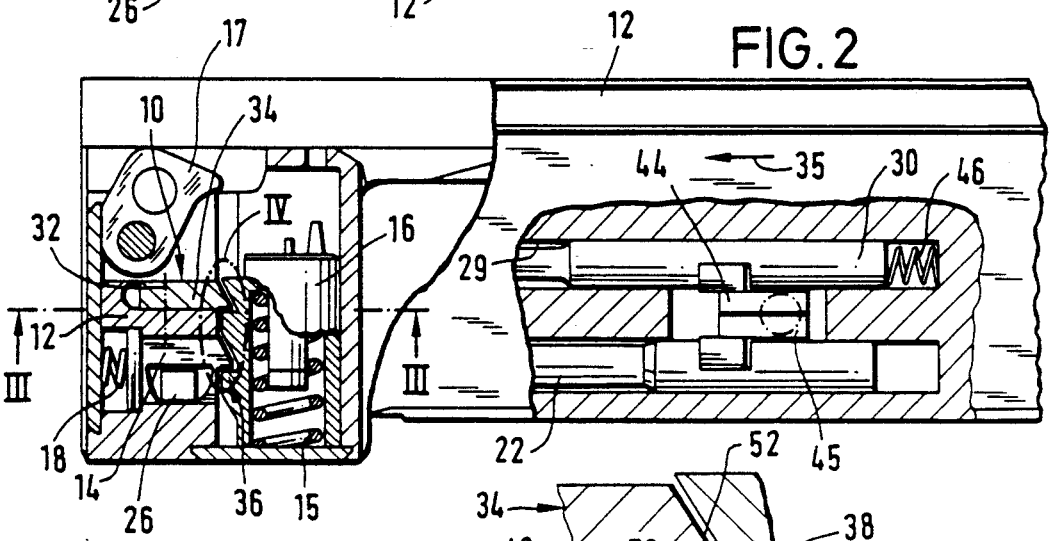
FIG. 2 is a sectional side elevational view taken along the line II—II in FIG. 1.
Figure 4:
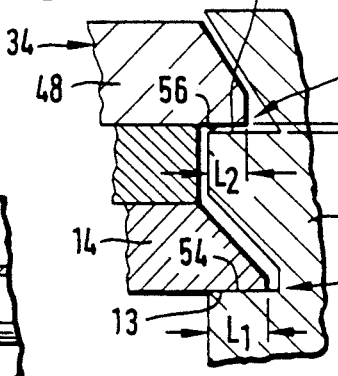
FIG. 4 is an enlarged partial sectional view of the region enclosed by inset IV in FIG. 2.
Figure 3:
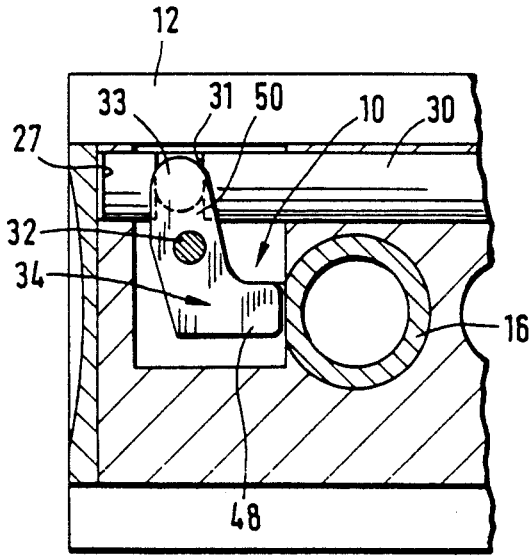
FIG. 3 is an enlarged partial sectional side view taken along line III—III in FIG. 2.
Figure 5:
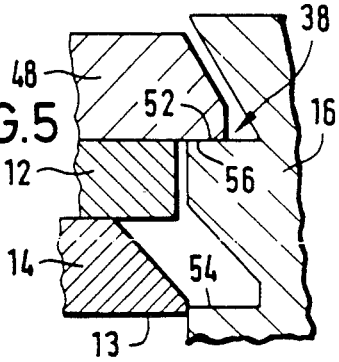
FIG. 5 is a view similar to the view in FIG. 4, showing the components in a different operational position.

FIGS. 2 and 4 show the assumption of a normal locking position 38 by the standby catch 34, as well as a proper normal locking position 36 by the catch 14. In contrast, FIG. 5 shows the situation which can arise, for example, after the catch 14 has made a "side catch", that is, the catch 14 abuts the side of the firing pin 16 instead of engaging the intended first detent surface 54. Despite the sliding off of the intercepting pin 14 from the first detent surface 54 of the firing pin 16, the firing pin is secured and restrained in its cocked position by the standby catch 34, since the securing surface 56 thereof now engages the detent surface 52 of the firing pin 16.

In order to ensure that the pressing rod 42 supported in the breech plate 40 of the weapon can concurrently release the catch 14 and the standby catch 34, the first and second rocker lever bars 22, 30 each have means for transmitting this releasing motion. Such transmission means includes a respective angled lever 44, 45 symmetrically disposed relative to the pressing rod 42 and positively engaging each rocker lever bar. The angled levers 44, 45 are located between the first and second rocker lever bars 22, 30 and are situated next to each other, and, during the releasing process, overlap the front engaging surface of the pressing rod 42 so that both rocker lever bars are concurrently slid in the direction of the arrow 43.

For ensuring that the firing pin 16 can freely execute its movement when released, the overlapping length $L_2$ between the standby catch 34 and the second detent surface 52 of the firing pin 16 is between 10 to 15% shorter than the overlapping distance $L_1$ between the catch 14 and the first detent surface 54 of the firing pin 16.

It will be understood that the above description of the present invention is susceptible to various modifications, changes, and adaptations, and the same are intended to be comprehended within the meaning and range of equivalents of the appended claims.

What is claimed is:

1. A trigger mechanism comprising (a) a firing pin having a cocked position and a firing position into which the firing pin is adapted to be accelerated along a path of motion from the cocked position;

(b) a catch having a locking position for engaging the firing pin in the cocked position to hold the firing pin in the cocked position; said catch having a withdrawn position for allowing the firing pin to be moved into the firing position;

(c) a spring operatively connected to said catch for urging said catch into the locking position;

(d) a first actuating bar;

(e) first coupling means for connecting said first actuating bar with said catch for transferring movements of said first actuating bar to said catch;

(f) a standby catch having a locking position in which the standby catch is situated in the path of motion of and out of contact with the firing pin for preventing the firing pin from moving from the cocked positioned into the firing position; said standby catch having a withdrawn position for allowing the firing pin to be moved into the firing position;

(g) a second actuating bar; said first and second actuating bars being longitudinally displaceable and oriented parallel to one another;

(h) second coupling means for connecting said second actuating bar with said standby catch for transferring movements of said second actuating bar to said standby catch; and (i) force-transmitting means for simultaneously applying a triggering force to said first and second actuating bars for simultaneously displacing said first and second actuating bars to simultaneously move said catch and said standby catch from respective said locking positions to respective said withdrawn positions.

2. A trigger mechanism as defined in claim 1, wherein said first coupling means comprises (a) means defining a first recess in said first actuating bar;

(b) means defining a second recess in said catch; and (c) a pivotally supported rocker lever having a first arm extending into said first recess and a second arm extending into said second recess.

3. A trigger mechanism as defined in claim 1, further comprising means for pivotally supporting said standby catch.

4. A trigger mechanism as defined in claim 3, wherein said second coupling means comprises means defining a recess in said second actuating bar and a lug affixed to said standby catch and extending into said recess.

5. A trigger mechanism as defined in claim 1, wherein said first and second actuating bars include means defining respective recesses therein; further wherein said force-transmitting means comprise two pivotally supported angled levers each having a first arm and a second arm; respective first arms of said angled levers extending into the respective recess of said first and second actuating bars; and respective second arms of said angled levers being arranged for a simultaneous exposure to the triggering force to be transmitted to said first and second actuating bars.

6. A trigger mechanism as defined in claim 1, wherein said spring is a first spring; further comprising a second spring connected to said second actuating bar for continuously urging said standby catch toward the locking position thereof.

7. A trigger mechanism as defined in claim 1, wherein said standby catch is a pivotally supported angled member having a first arm connected to said second actuating bar by said second coupling means and a second arm having a terminus cooperating with said firing pin; said first and second arms are oriented at 90° to one another.

8. A trigger mechanism as defined in claim 1, further wherein said firing pin has a first and a second detent surface; in said locking position of said catch said catch being in an abutting engagement with said first detent surface; in said locking position of said standby catch said standby catch being in alignment and out of contact with said second detent surface when said catch is in said abutting engagement with said first detent surface; and in said locking position of said standby catch said standby catch being in an abutting engagement with said second detent surface when said catch is out of contact with said first detent surface.

9. A trigger mechanism as defined in claim 8, wherein said first detent surface has a first length along which said catch is in an overlapping relationship with said first detent surface in the locking position of said catch and said second detent surface has a second length along which said standby catch is in an overlapping relationship with said second detent surface in the locking position of said standby catch; said second length being 10%–15% smaller than said first length.

10. A trigger mechanism comprising (a) a firing pin having a cocked position and a firing position into which the firing pin is adapted to be accelerated along a path of motion from the cocked position;

(b) a catch having a locking position for engaging the firing pin the cocked position to hold the firing pin in the cocked position; said catch having a withdrawn position for allowing the firing pin to be moved into the firing position;

(c) a spring operatively connected to said catch for urging said catch into the locking position;

(d) a first actuating bar;

(e) first coupling means for connecting said first actuating bar with said catch for transferring movements of said first actuating bar to said catch; said first coupling means including:

(i) means defining a first recess in said first actuating bar;

(ii) means defining a second recess in said catch; and (iii) a pivotally supported rocker lever having a first arm extending into said first recess and a second arm extending into said second recess;

(f) a standby catch having a locking position in which the standby catch is situated in the path of motion of and out of contact with the firing pin for preventing the firing pin from moving from the cocked position into the firing position; said standby catch having a withdrawn position for allowing the firing pin to be moved into the firing position;

(g) a second actuating bar;

(h) second coupling means for connecting said second actuating bar with said standby catch for transferring movements of said second actuating bar to said standby catch; and (i) force-transmitting means for simultaneously applying a triggering force to said first and second actuating bars for simultaneously displacing said first and second actuating bars to simultaneously move said catch and said standby catch from respective said locking positions to respective said withdrawn positions.

11. A trigger mechanism as defined in claim 10, wherein said first and second actuating bars include means defining respective recesses therein; further wherein said force-transmitting means comprise two pivotally supported angled levers each having a first arm and a second arm; respective first arms of said angled levers extending into the respective recess of said first and second actuating bars; and respective second arms of said angled levers being arranged for a simultaneous exposure to the triggering force to be transmitted to said first and second actuating bars.

12. A trigger mechanism as defined in claim 10, wherein said spring is a first spring; further comprising a second spring connected to said second actuating bar for continuously urging said standby catch toward the locking position thereof.

13. A trigger mechanism as defined in claim 10, wherein said standby catch is a pivotally supported angled member having a first arm connected to said second actuating bar by said second coupling means and a second arm having a terminus cooperating with said firing pin; said first and second arms are oriented at 90° to one another.

14. A trigger mechanism comprising:

(a) a firing pin having a cocked position and a firing position into which the firing pin is adapted to be accelerated along a path of motion from the cocked position;

(b) a catch having a locking position for engaging the firing pin in the cocked position to hold the firing pin in the cocked position; said catch having a withdrawn position for allowing the firing pin to be moved into the firing position;

(c) a spring operatively connected to said catch for urging said catch into the locking position;

(d) a first actuating bar;

(e) first coupling means for connecting said first actuating bar with said catch for transferring movements of said first actuating bar to said catch;

(f) a standby catch having a locking position in which the standby catch is situated in the path of motion of and out of contact with the firing pin for preventing the firing pin from moving from the cocked position into the firing position; said standby catch having a withdrawn position for allowing the firing pin to be moved into the firing position;

(g) means for pivotally supporting said standby catch;

(h) a second actuating bar;

(i) second coupling means for connecting said second actuating bar with said standby catch for transferring movements of said second actuating bar to said standby catch; said second coupling means comprising means defining a recess in said second actuating bar and a lug affixed to said standby catch and extending into said recess; and (j) force-transmitting means for simultaneously applying a triggering force to said first and second actuating bars for simultaneously displacing said first and second actuating bars to simultaneously move said catch and said standby catch from respective said locking positions to respective said withdrawn positions.

15. A trigger mechanism comprising (a) a firing pin having a cocked position and a firing position into which the firing pin is adapted to be accelerated along a path of motion from the cocked position;

(b) a catch having a locking position for engaging the firing pin in the cocked position to hold the firing pin in the cocked position; said catch having a withdrawn position for allowing the firing pin to be moved into the firing position;

(c) a spring operatively connected to said catch for urging said catch into the locking position;

(d) a first actuating bar;

(e) first coupling means for connecting said first actuating bar with said catch for transferring movements of said first actuating bar to said catch;

(f) a standby catch having a locking position in which the standby catch is situated in the path of motion of and out of contact with the firing pin for preventing the firing pin from moving from the cocked position into the firing position; said standby catch having a withdrawn position for allowing the firing pin to be moved into the firing position;

(g) a second actuating bar; said first and second actuating bars including means defining rspective recesses therein;

(h) second coupling means for connecting said second actuating bar with said standby catch for transferring movement of said second actuating bar to said standby catch; and (i) force-transmitting means for simultaneously applying a triggering force to said first and second actuating bars for simultaneously displacing said first and second actuating bars to simultaneously move said catch and said standby catch from respective said locking positions to respective said withdrawn positions; said force-transmitting means comprising two pivotally supported angled levers each having a first arm and a second arm; respective first arms of said angled levers extending into the respective recess of said first and second actuating bars; and respective second arms of said angled levers being arranged for a simultaneous exposure to the triggering force to be transmitted to said first and second actuating bars.

16. A trigger mechanism comprising (a) a firing pin having a cocked position and a firing position into which the firing pin is adapted to be accelerated along a path of motion from the cocked position;

(b) a catch having a locking position for engaging the firing pin in the cocked position to hold the firing pin in the cocked position; said catch having a withdrawn position for allowing the firing pin to be moved into the firing position;

(c) a first spring operatively connected to said catch for urging said catch into the locking position;

(d) a first actuating bar;

(e) first coupling means for connecting said first actuating bar with said catch for transferring movements of said first actuating bar to said catch;

(f) a standby catch having a locking position in which the standby catch is situated in the path of motion of and out of contact with the firing pin for preventing the firing pin from moving from the cocked position into the firing position; said standby catch having a withdrawn position for allowing the firing pin to be moved into the firing position;

(g) a second actuating bar;

(h) a second spring connected to said second actuating bar for continuously urging said standby catch toward the locking position thereof;

(i) second coupling means for connecting said second actuating bar with said standby catch for transferring movements of said second actuating bar to said standby catch; and (j) force-transmitting means for simultaneously applying a triggering force to said first and second actuating bars for simultaneously displacing said first and second actuating bars to simultaneously move said catch and said standby catch from respective said locking positions to respective said withdrawn positions.

17. A trigger mechanism comprising:

(a) a firing pin having a cocked position and a firing position into which the firing pin is adapted to be accelerated along a path of motion from the cocked position; said firing pin having a first and a second detend surface;

(b) a catch having a locking position for engaging the firing pin in the cocked position to hold the firing pin in the cocked position; in said locking position of said catch said catch being in an abutting engagement with said first detent surface; said catch having a withdrawn position for allowing the firing pin to be moved into the firing position;

(c) a spring operatively connected to said catch for urging said catch into the locking position;

(d) a first actuating bar;

(e) first coupling means for connecting said first actuating bar with said catch for transferring movements of said first actuating bar to said catch;

(f) a standby catch having a locking position in which the standby catch is situated in the path of motion of and out of contact with the firing pin for preventing the firing pin from moving from the cocked position into the firing position; in said locking position of said standby catch said standby catch being in alignment and out of contact with said second detent surface when said catch is in said abutting engagement with said first detent surface; and in said locking position of said standby catch said standby catch being in an abutting engagement with said second detent surface when said catch is out of contact with said first detent surface; said standby catch having a withdrawn position for allowing the firing pin to be moved into the firing position;

(g) a second actuating bar;

(h) second coupling means for connecting said second actuating bar with said standby catch for transferring movements of said second actuating bar to said standby catch; and (i) force-transmitting means for simultaneously applying a triggering force to said first and second actuating bars for simultaneously displacing said first and second actuating bars to simultaneously move said catch and said standby from respective said locking positions to respective said withdrawn positions.

18. A trigger mechanism as defined in claim 17, wherein said first detent surface has a first length along which said catch is in an overlapping relationship with said first detent surface in the locking position of said catch and said second detent surface has a second length along which said standby catch is in an overlapping relationship with said second detent surface in the locking position of said standby catch; said second length being 10%–15% smaller than said first length.

* * * * *